US006509835B1

(12) United States Patent
Krubiner et al.

(10) Patent No.: US 6,509,835 B1
(45) Date of Patent: Jan. 21, 2003

(54) FILTERING METHOD AND CIRCUIT PARTICULARLY USEFUL IN DOPPLER MOTION SENSOR DEVICES AND INTRUSION DETECTOR SYSTEMS

(75) Inventors: Dani Krubiner, Tel-Aviv (IL); Bar Strauss, Matan (IL); Eyal Yagoda, Tel-Aviv (IL)

(73) Assignee: Electronics Line (E.L.) Ltd., Petach Tikva (IL)

( * ) Notice: Subject to any disclaimer, the term of this patent is extended or adjusted under 35 U.S.C. 154(b) by 0 days.

(21) Appl. No.: 09/455,003

(22) Filed: Dec. 6, 1999

(30) Foreign Application Priority Data

Dec. 7, 1998 (IL) ..... 127438

(51) Int. Cl.[7] ..... G08B 13/18
(52) U.S. Cl. ..... 340/554; 340/541
(58) Field of Search ..... 340/554, 552, 340/541, 540; 367/90; 342/195, 115

(56) References Cited

U.S. PATENT DOCUMENTS 3,828,336 A * 8/1974 Massa ..... 367/94
3,967,283 A * 6/1976 Clark et al. ..... 340/554
4,398,274 A * 8/1983 Chotiros ..... 342/189

* cited by examiner

*Primary Examiner*—Jeffery Hofsass
*Assistant Examiner*—Sihong Huang
(74) *Attorney, Agent, or Firm*—Eitan, Pearl, Latzer & Cohen-Zedek

(57) ABSTRACT

A method of filtering an input signal which includes noise cyclically repeating at a known noise frequency, to substantially remove said noise from the input signal is provided. The method includes sampling the input signal at a frequency corresponding to a whole multiple "N" of the noise frequency; sequentially storing the samples in 0-N storage devices; sequentially subtracting the sample in each storage device from the sample previously stored in the $N^{th}$ storage device preceding the respective storage device, to thereby produce for each sample, a difference sample in which the cyclically repeating noise is effectively cancelled from the respective sample; and sequentially outputting the difference samples to produce an output signal from which the cyclically repeating noise has been substantially removed.

33 Claims, 8 Drawing Sheets

FILTERING METHOD AND CIRCUIT PARTICULARLY USEFUL IN DOPPLER MOTION SENSOR DEVICES AND INTRUSION DETECTOR SYSTEMS

FIELD AND BACKGROUND OF THE INVENTION

The present relates to a method and circuit for electronically filtering a signal. The invention is particularly useful in Doppler motion sensor devices, such as used in intrusion detector systems, and is therefore described below with respect to such an application, but it will be appreciated that the invention, or various aspects thereof, can also be used in many other applications.

Intruder detector systems are generally based on infrared radiation devices and/or microwave or ultrasonic Doppler devices, for sensing the motion of an object within the protected space. Infrared radiation devices sense the motion of a heat source, whereas Doppler devices sense the motion of physical masses which reflect the microwave or ultrasonic waves. Both types of devices tend to produce false alarms which, if occurring too frequently, can affect the integrity of the intrusion detector system. Accordingly, in some applications, the intrusion detector system may include both types of devices both of which must be actuated to actuate the alarm in order to minimize false alarms.

Since the Doppler device is based on reflecting microwaves or ultrasonic waves from an object within the monitored space, such devices are particularly prone to the production of false alarms by various types of moving objects within the monitored space. Particularly troublesome are electrical devices, such as a fluorescent lights, energized by the electrical supply mains. Thus, in a fluorescent light, the gas within the tube produces a moving "heat front" from one end of the tube towards the opposite end with each ignition of the tube, such as to simulate a moving heat source which could be incorrectly interpreted by the intrusion detector system as a moving intruder.

As the frequency of the supply mains is known, one way of avoiding this source of false alarms is by subtracting the line frequency from the signal outputted by the Doppler detector device. However, harmonics of the line frequency are also generated by the fluorescent light, and harmonics can also produce a false alarm. Therefore, it would be necessary to make a computation and subtraction for each such harmonic, which is a costly and time consuming process. Moreover, the interference signal may be so strong as to mask the true signal.

Another source of false alarms particularly in Doppler intrusion detector systems are objects, such as fans, moving at a relatively constant velocity within the monitored space. The motion of such devices can also be incorrectly interpreted as an intruder to produce a false alarm.

OBJECTS AND BRIEF SUMMARY OF THE INVENTION

An object of the present invention is to provide a filtering method and circuit particularly useful in microwave or ultrasonic Doppler detector systems for reducing one or both of the above sources of false alarms in such systems. Another object of the present invention is to provide a Doppler motion detector system, and also an intrusion detector system, having advantages in the above-described respects.

According to one aspect of the present invention, there is provided a method of filtering an input signal which includes noise cyclically repeating at a known noise frequency, to substantially remove said noise from the input signal, comprising: sampling the input signal at a frequency corresponding to a whole multiple "N" of the noise frequency; sequentially storing the samples in 0-N storage devices; sequentially subtracting the sample in each storage device from the sample previously stored in the $N^{th}$ storage device preceding the respective storage device, to thereby produce for each sample, a difference sample in which the cyclically repeating noise is effectively cancelled from the respective sample; and sequentially outputting the difference samples to produce an output signal from which the cyclically repeating noise has been substantially removed.

According to further features in the described preferred embodiment, "N" is preferably a whole number greater than "1" such that the harmonics of the cyclically-repeating noise are also substantially removed. For example, where the supply line is at a frequency of 50 Hz, "N" is preferably "12", whereupon the sampling frequency would be 600 Hz; and as will be shown below, such a sampling frequency will be effective with respect to the fundamental (the line) frequency of 50 Hz, and also with respect to its harmonics 100 Hz, 150 Hz and 200 Hz. Similarly, if the line frequency is 60 Hz and "N" is 12, the sampling frequency would be 720 Hz, whereupon the filtering circuit would be effective with respect to the corresponding line frequency and its harmonics.

The novel method, therefore, does not require computing and subtracting each harmonic, nor the costly and time-consuming procedure that would be involved. Moreover, the novel method removes the cyclically repeating noise even where that noise is so strong that it might otherwise tend to mask the true signals.

According to further features in the preferred embodiment described below, the input signal being filtered is the output of a microwave or ultrasonic Doppler motion sensor device in an intrusion detector system. When used in such a system, other operations may be performed, in addition to or in lieu of the foregoing operations. In order to reduce the possibility of constantly-moving objects, such as fans, within the monitored space producing a false alarm. These other operations could include the following: examining each sample of the input signal for a change in amplitude over the previous sample; for each such changes in amplitude over a threshold, measuring the duration of the change in amplitude from the time of the amplitude change until the time the amplitude of a subsequent sample input signal drops below the threshold; and maintaining an alarm signal only for those changes in amplitude having a duration shorter than a predetermined time period. In the described preferred embodiment, an alarm signal is produced whenever a change in amplitude is detected over a threshold with respect to the previous signal, and the alarm signal is terminated whenever the duration exceeds a predetermined time period.

According to another aspect of the present invention, there is provided an electronic filter for filtering an input signal which includes noise cyclically repeating at a known noise frequency, to substantially remove the noise from the input signal, comprising: means for sampling the input signal at a frequency corresponding to a whole multiple "N" of the noise frequency; a shift register including 0-N registers for sequentially storing the samples in the registers, and for reading them out from the registers in a FIFO manner; and a subtractor for sequentially subtracting the sample in each register from the sample previously stored in the $N^{th}$ register to thereby sequentially produce, for each sample, a difference sample in which the cyclically-repeating noise is effectively cancelled from the respective sample. As will be described more particularly below, such a filter acts as a dynamic electronic filter to filter out the cyclically repeating noise from the input signal. In the described preferred embodiment, this dynamic filter is implemented by software in a processor.

According to a still further aspect of the present invention, there is provided a Doppler motion sensor device for sensing motion of an object, comprising: a transmitter for transmitting energy (microwaves or ultrasonic waves); a receiver for receiving the energy after reflection from an object; a mixer for mixing the transmitted energy and the received energy, and for outputting a signal representing the velocity of motion of an object reflecting the energy; and an electronic filter as described above for substantially removing cyclically-repeating noise from the output signal from the mixer.

The Doppler motion sensor, theoretically, could be used as a stand-alone system for detecting intrusions. However, in order to minimize the possibility of false alarms, it is preferable that the intrusion detector system includes both the above-described Doppler motion sensor device, and also an infra-red radiation motion sensor device, such that the alarm would be actuated only when both devices output an alarm signal within a predetermined time window.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
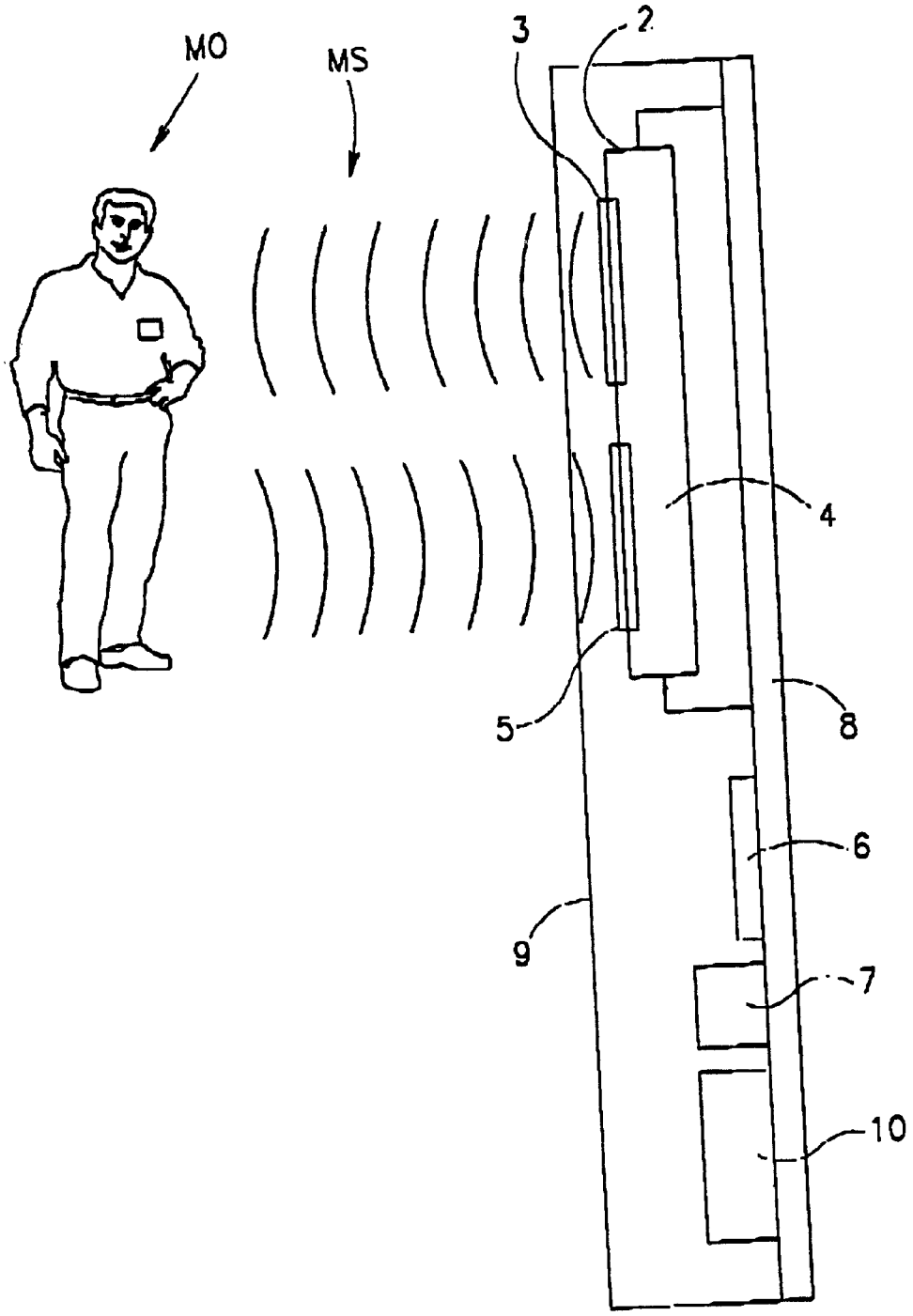
FIG. 1 schematically illustrates one form of Doppler motion sensor apparatus constructed in accordance with one aspect of the present invention.

With reference first to FIG. 1, there is schematically illustrated a microwave Doppler type of motion sensor, including a transmitter 2 for transmitting, via an antenna 3, microwaves into the monitored space MS in order to detect a moving object MO therein. A moving object within the monitored space MS will reflect the microwaves back to a receiver 4, having an antenna 5. The received microwaves will vary in frequency and amplitude according to the velocity and distance of motion of the moving object MO. The transmitted and received signals are amplified in an amplifier circuit 6, and are mixed in a mixer 7, such that the signal outputted is by the mixer 7 is a dynamic representation of the velocity of motion of the moving object MO.

As known, such Doppler devices may be based on the transmission and reception of ultrasonic waves, rather than microwaves, in which case elements 3 and 6 could be piezoelectric devices, rather than antennas. Since Doppler motion sensor devices are well known, further details of its construction and operation are not set forth herein.

In the example illustrated in FIG. 1, all the foregoing elements are mounted on a printed circuit board 8 enclosed within a cover 9. Also mounted on the printed circuit board 8 is a CPU 10 which processes the signal outputted by the mixer 7 in a manner to be described below.

Figure 2:
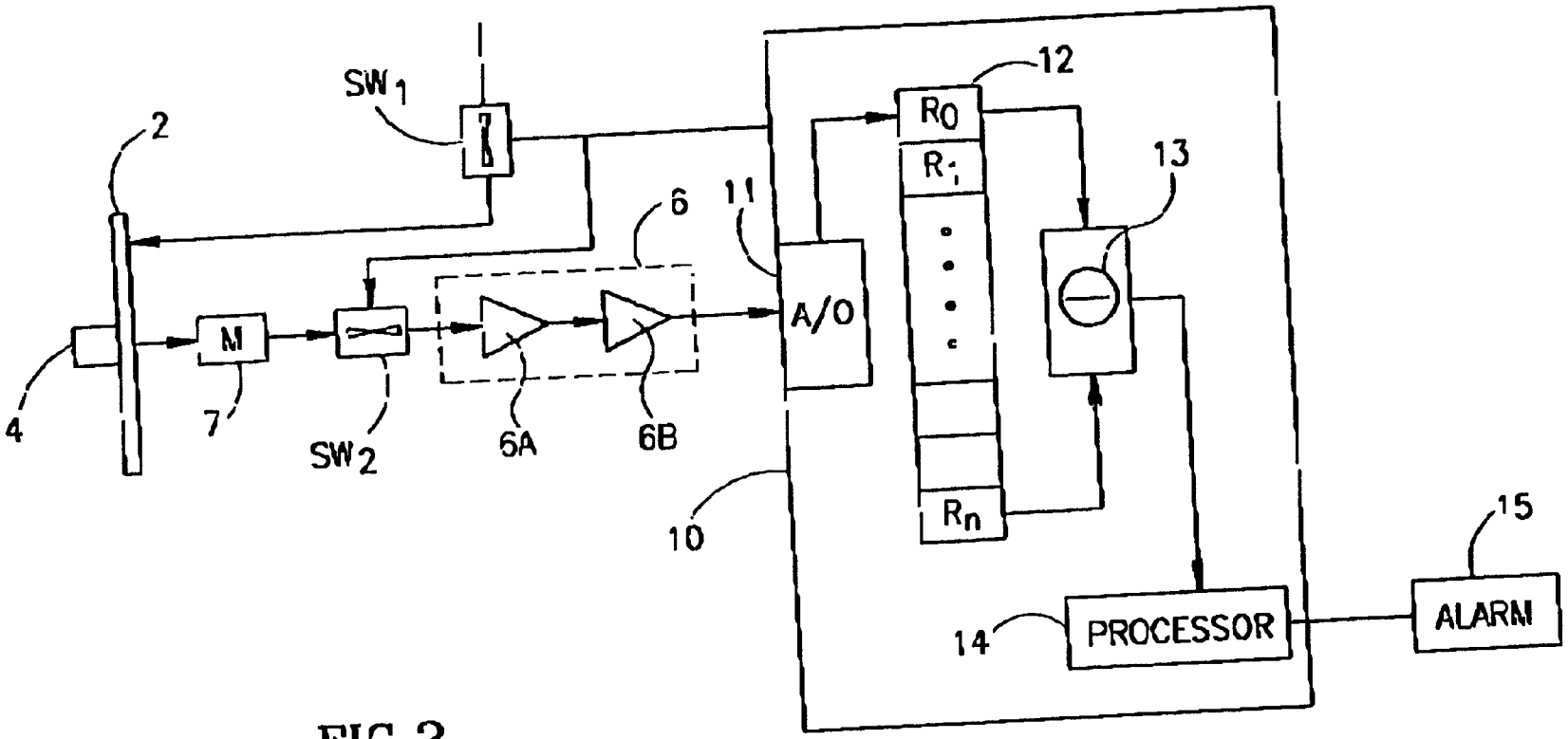
FIG. 2 is a block diagram illustrating the main electrical components in the apparatus of FIG. 1.

With reference to FIG. 2, the transmitter 2 is controlled by a switch $SW_1$ to produce a burst of 3 KHz pulses for a duration of 30 micro-seconds during each 300 micro-second period, i.e., to produce a 10% duty cycle to save energy. A sample and hold switch $SW_2$ receives the output from the mixer 7. The output is amplified by an amplifier circuit 6, including active filters 6*a*, 6*b*, before being fed to the CPU 10.

For example, assuming that the monitored objects MO to be detected within the monitored space MS may move at a velocity of 0.5–5 meters per second, such objects would produce an output from mixer 7 of 10–180 Hz. Active filters 6*a*, 6*b* are designed to amplify and pass signals within the range of 10–180 Hz to the CPU 10.

As shown in FIG. 2, the CPU 10 includes an A/D converter 11 for converting the analog output from the mixer 7 to digital form. The CPU is programmed to define a shift register 12 including "N" registers ($R_0$-$R_n$) operating according to the FIFO (First In First Out) mode.

CPU 10 further defines a subtractor 13 connected to subtract the output of the first register $R_0$ from the output of the last register $R_n$ and to feed the difference to a processing circuit 14. The latter circuit is connected to an alarm 15 which is actuated when the data being processed produces an alarm signal to indicate that an intrusion has occurred. However, the CPU 10, and particularly its shift register 12 and subtractor 13, are operated in a manner, to be described more particularly below, which minimizes false alarms, i.e., minimizes the actuation of the alarm 15 by occurrences within the monitored space MS which might appear to be an intrusion but which, in fact, are not an intrusion.

As briefly described earlier, one of the causes for a false alarm could be the operation of a fluorescent lamp within the monitored space MS, since such lamps produce what appear to be "motions" of the gas from one end to the other at the frequency of the electrical supply line, e.g., 50 Hz. The voltage changes in the signal outputted from the mixer 7 due to the operation of a fluorescent lamp are therefore not to be treated as true signals, but rather as spurious signals or noise, and are to be distinguished from the voltage changes in the output of the mixer representing true signals caused by an actual intrusion within the monitored space MS.

Noise produced by fluorescent lamps, or other cyclically energized electrical devices within the monitored space MS, cyclically repeats itself at the line frequency, e.g., 50 Hz. This characteristic is used by the CPU 10, and particularly its shift register 12 and subtractor 13, for identifying the cyclically repeating noise and for removing it from the signal outputted by the mixer 7 into the CPU 10 for processing to determine whether or not an actual intrusion has occurred.

For this purpose, after the signal outputted from the mixer 7 is amplified and filtered by the active filters 6*a* and 6*b*, it is sampled by the CPU 10 at a frequency corresponding to a whole multiple "N" of the noise frequency, e.g., the frequency of the electrical supply line producing the noise. In the example illustrated in FIGS. 2–4, "N" is equal to 12. If the line frequency is 60 Hz, the sampling frequency would be 720 Hz; on the other hand, if the line frequency is 50 Hz, the sampling frequency would be 600 Hz.

Shift register 12 has N+1 registers, i.e., 13 registers in this example, labeled $R_0$–$R_{12}$. The shift register sequentially receives the samples via its first register $R_0$, advances the contents of each register to the next, and reads out the samples from the last register $R_N$ (in this case $R_{12}$) in a FIFO manner. Subtractor 13 sequentially subtracts each sample outputted from the first register $R_0$ from the sample in the last register $R_{12}$, and outputs the difference to the processor circuit 14.

In this manner, the CPU 10, particularly its shift register 12 and subtractor 13, acts as a dynamic electronic filter for filtering the signal outputted from the mixer 7 (after amplification and filtering by the active filters 6*a,* 6*b*) to remove voltage changes therein representing cyclically repeating noise, (e.g., generated from fluorescent lamps) from the true signal indicating a possible intrusion into the monitored space MS. This filtering action is effective, not only with respect to the noise frequency, (e.g., 50 Hz), but also with respect to harmonics of this noise frequency.

Figure 3A:
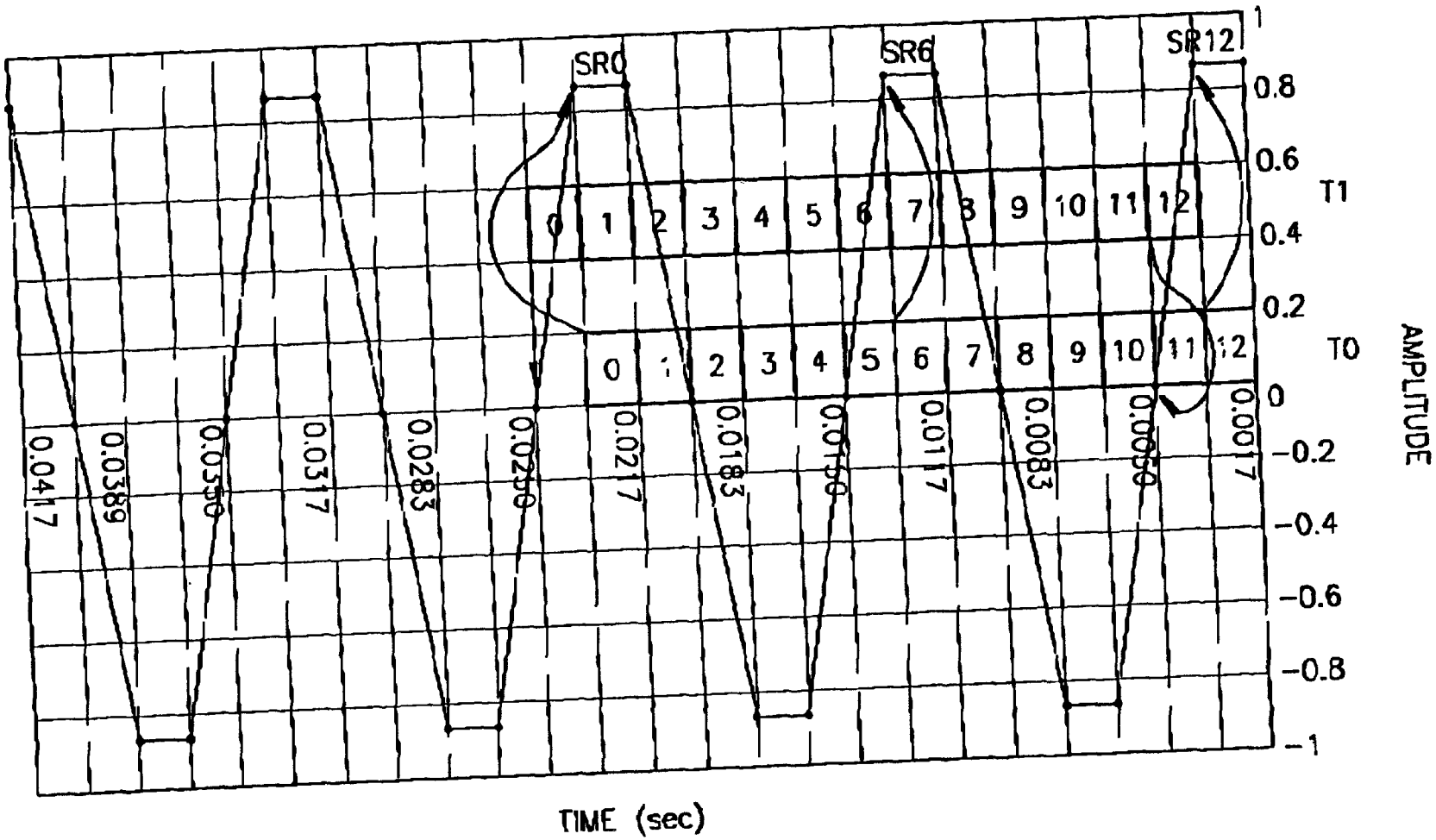
FIGS. 3*a* and 3*b* are diagrams helpful in explaining the operation of the apparatus of FIGS. 1 and 2.
Figure 3B:
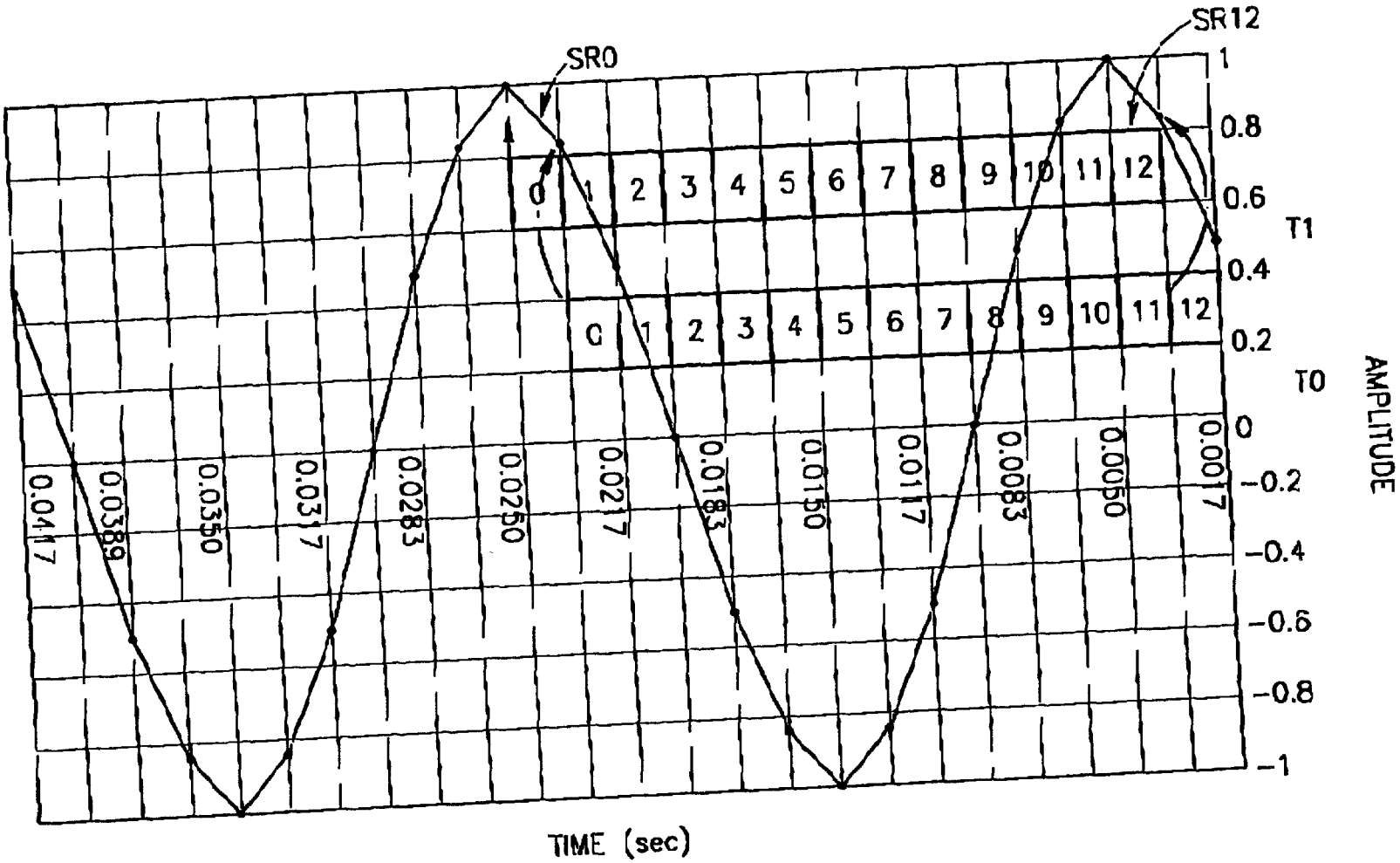

The diagrams of FIGS. 3 and 3*a* more clearly show how this filtering action is produced both with respect to the noise fundamental frequency, (e.g., 50 Hz), and also with respect to its harmonics.

Thus, each register $R_0$-$R_n$ has a capacity for storing a sample (e.g., 8 bits) representing the amplitude of the amplified mixer output. The value of the first sample, and that of every sample thereafter, are fed into the first register $R_0$, are sequentially advanced through the other registers, and are read out from the last register $R_n$ ($R_{12}$ in this case) in a FIFO manner. As the value of the sample in the last register ($R_n$) is read out of the shift register, there is subtracted from it the value of the sample in the first register ($R_0$). FIG. 3 shows how this process of sampling, shifting and subtracting removes the fundamental frequency of the noise from the output of the mixer; and FIG. 3*a* shows how this also removes the first harmonic of the noise frequency.

FIG. 3 illustrates a circuit wherein the line frequency is 50 Hz, whereupon the sampling rate would be 600 Hz, i.e., every 1.67 ms. $SR(t_0)$ indicate the condition of the shift register 12 after all the registers have been filled in a FIFO manner; and $SR(t_1)$ illustrates its condition upon the first shift thereafter when receiving the next sample. When the value of the sample in the last register, $SR_{12}$, is read out from the shift register, there is subtracted therefrom the value of the sample in the first register, $SR_0$. As seen in FIG. 3, the two values are equal, and therefore the difference produced by the subtraction will be "0".

It will also be seen from FIG. 3 that at the time of the next sample (1.67 ms), the value in the last register will also be equal to the value in the first register, and therefore this subtraction will again produce "0". The foregoing operations are repeated with each sampling of the output from the mixer.

Accordingly and as shown in FIG. 3, the illustrated arrangement, including shift register 12 and subtractor 13, will thus substantially remove the voltage changes in the output of the mixer 7 attributed to the operation of the fluorescent lamp at line frequency, or any other noise cyclically repeating at the line frequency.

It will also be seen from FIG. 3*a* that each voltage change attributed to the first harmonic of the line frequency will also repeat itself every six samples. That is, when the value of the sample in the first register, $SR_0$ is subtracted from the value in the sixth register, $SR_6$, the difference again is "0". Therefore such noise will also be removed from the output of the mixer by the above-described sampling, shifting and subtracting operators before being fed to the processor circuit 14. Each voltage change attributed to the second harmonic of the line frequency will repeat itself every three samples, and such noise will therefore also be removed from the sequence of signals before being fed to the processor 14.

Figure 4:
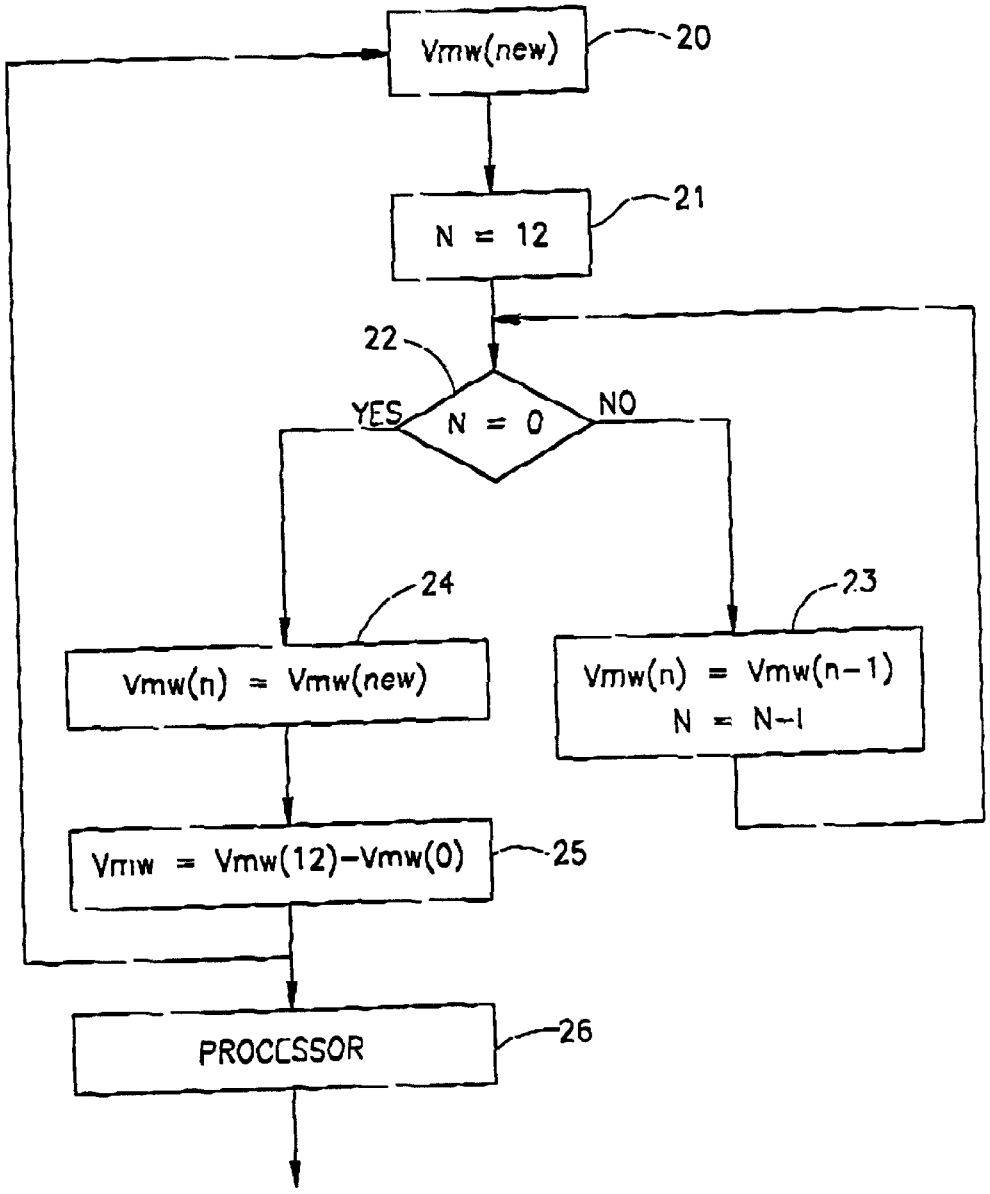
FIG. 4 is a flow chart illustrating the operation of the apparatus of FIGS. 1 and 2.

The flow chart of FIG. 4 more particularly illustrates this process. In the example illustrated, wherein the line frequency is 50 Hz "N" is 12, and the sampling, shifting, and subtracting frequency is 600 Hz. Thus, as shown in the flow chart of FIG. 4, as each sample is inputted into the shift register 12 (block 20), the value in each register is shifted until all 12 registers are full (blocks 21–23). When the next sample is inputted into the shift register (block 24), the value in the first shift register is subtracted from it (block 25), and the difference is outputted to the processor 14 (block 26) for further processing.

It will thus be seen that the input into processor 14 will be the output from the mixer (FIG. 1), after amplified in the active filters 6*a,* 6*b,* and after noise signals stemming from the line frequency, as well as its harmonics, have been removed by the sampling, shifting and subtracting operations performed in the CPU 10 as described above.

Processor circuit 14 processes the sequence of signals received from subtractor 13 and makes a determination of whether these signals indicate that an intrusion has in effect occurred within the monitored space MS, and if so, it outputs an alarm signal to the alarm 15. Since the sequence of signals received by processor 14 does not include noise generated by the operation of a fluorescent lamp within the monitored space MS, or any other noise cyclically repeating at the line frequency (e.g., 50 Hz), or one of its harmonics, there is a substantial reduction in the possibility that the processor 14 will produce a false alarm signal to actuate the alarm 15 when no intrusion has actually occurred.

As briefly described earlier, another source of "noise" which can create a false alarm is the operation of a device, such as a fan, at a constant velocity within the monitored space MS, since such a motion is also detected by the microwave Doppler device and may be misinterpreted as an intrusion within the monitored space.

Figure 5:
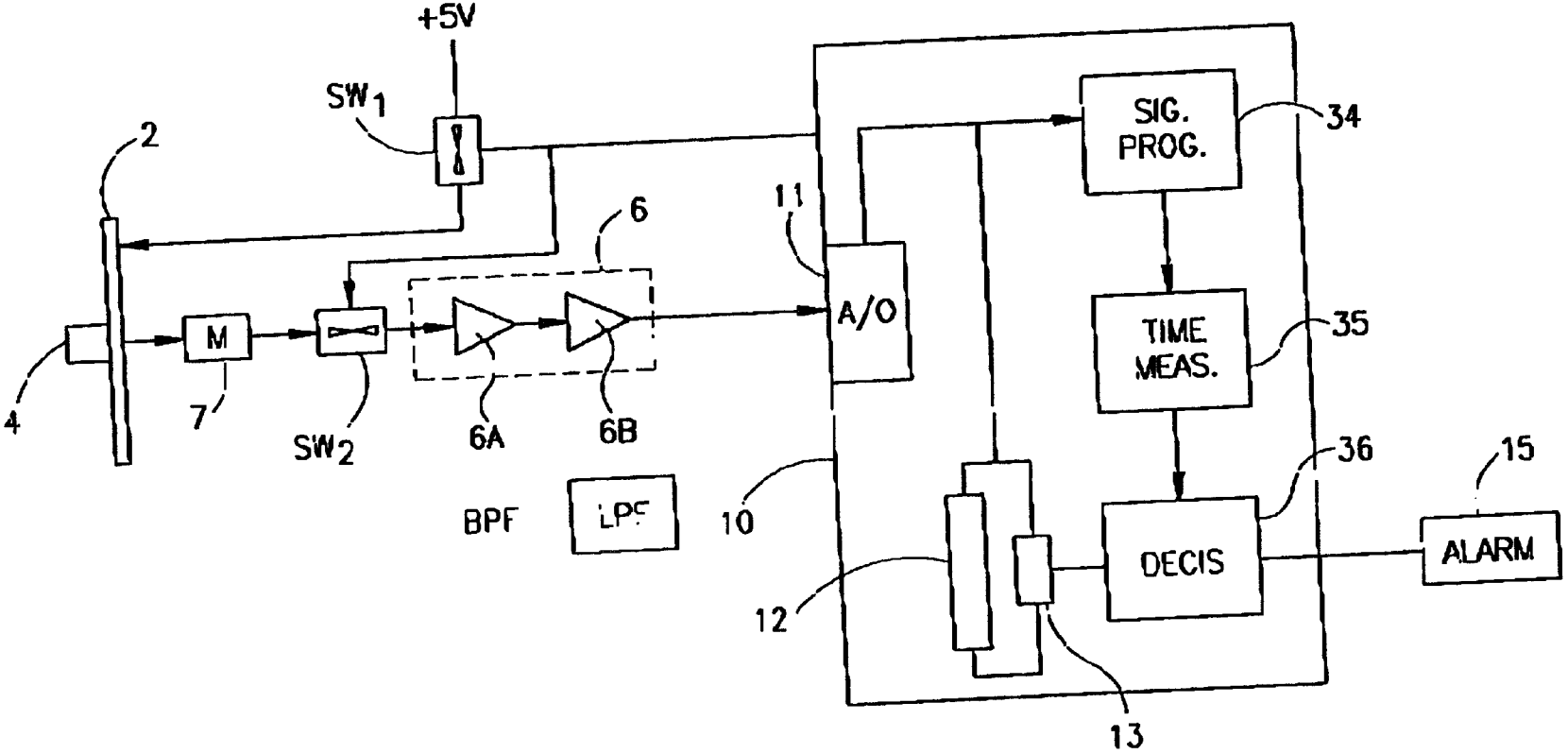
FIG. 5 is a block diagram illustrating another form of microwave Doppler motion sensor apparatus constructed in accordance with another aspect of the present invention.

FIG. 5 is a block diagram illustrating a microwave Doppler device, and particularly the modification of its CPU, for purposes of avoiding this possible source of false alarm. The construction of the Doppler device in FIG. 5 is basically the same as described above with respect to FIGS. 1 and 2, and therefore the same reference numerals have been used for identifying corresponding parts to facilitate understanding.

In the device illustrated in FIG. 5, however, the CPU therein designated 20, has been programmed also to include a signal processor 34, which cyclically examines samples to determine whether the sample of the filtered and amplified output from the mixer involves a change in amplitude over a predetermined threshold with respect to the previous sample. CPU 20 further includes a time-measuring circuit 35 which measures the duration of each no change in amplitude, or each change below the predetermined threshold; and a decision-making circuit 36, which decides whether an alarm signal indicating an intrusion, should be outputted to the alarm 15. In the preferred embodiment of the invention described below, the alarm signal is produced whenever a change in amplitude is detected over a predetermined threshold with respect to the previous signal; and the alarm signal is terminated automatically whenever the duration of time, until the next change in amplitude occurs, exceeds a predetermined period indicating that the source of the "noise" is an object moving at a constant velocity, (e.g., a fan) within the monitored space (not an intruder), and is therefore to be ignored.

Figure 6:
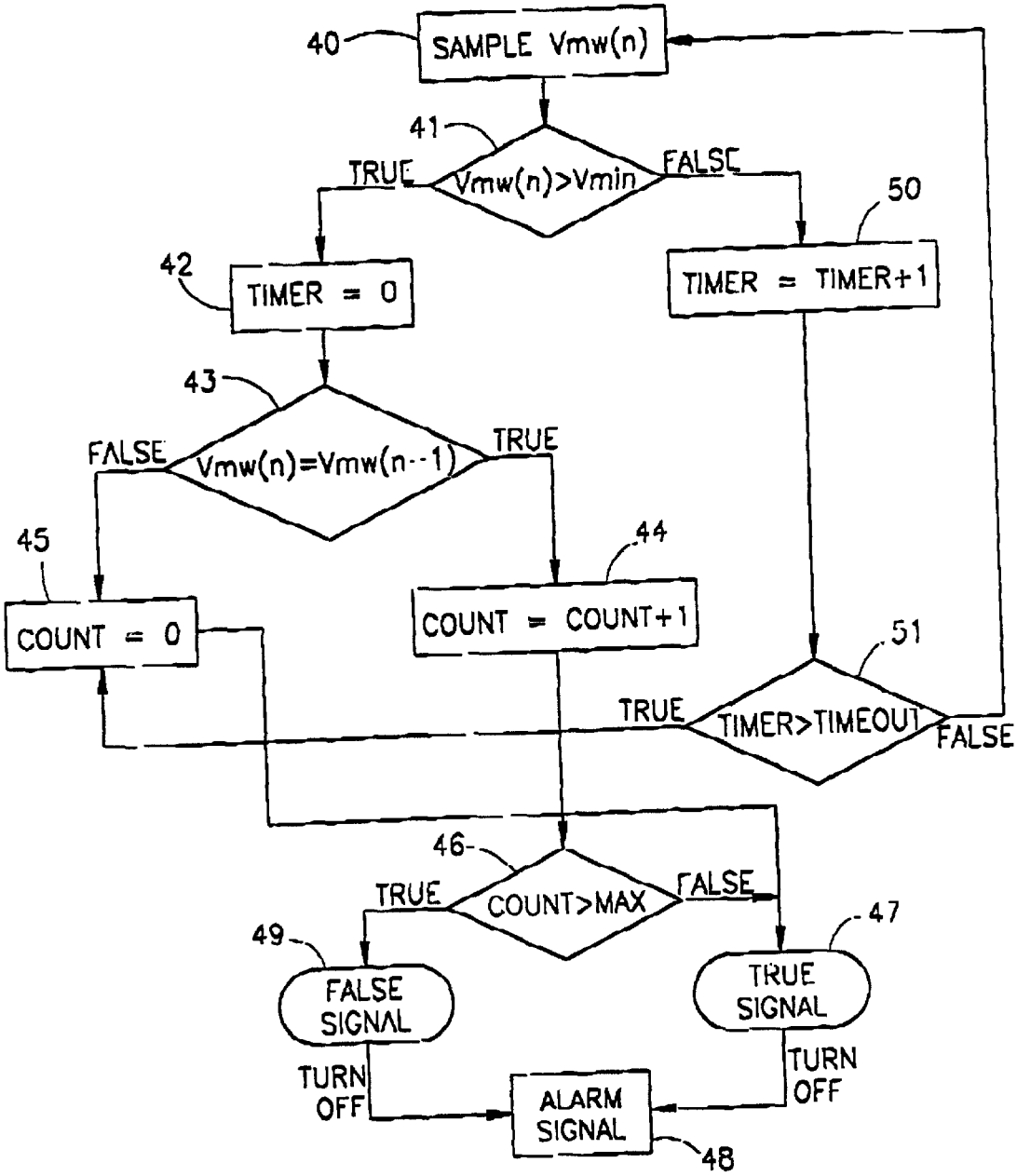
FIG. 6 is a flow chart illustrating the operation of the apparatus of FIG. 5.

The operation of CPU 20 illustrated in FIG. 5 is more particularly illustrated in the flow chart of FIG. 6. Thus, as shown in FIG. 6, a sample is cyclically received (block 40), and is checked to determine whether its amplitude is above a predetermined threshold (block 41). If so, a timer is zeroized (block 42), and a counter is incremented for each subsequent sample in which the amplitude is the same as that of the previous sample (blocks 43 and 44). Whenever the amplitude of a sample is found to be unequal to its preceding sample, the counter is zeroized (block 45).

If the count has not reached a predetermined maximum, e.g., 20 counts, (block 46), the alarm is actuated (blocks 47, 48). On the other hand, if the count does reach the predetermined maximum (20 counts), this indicates that the source of the signal is an object moving at a constant speed within the monitored space (e.g., a fan), and therefore is to be ignored. Accordingly, the alarm signal is terminated (block 49). If, however, the count does not reach the predetermined maximum, this indicates that the signal is a true signal (block 47), and therefore the alarm signal is not turned off but is maintained.

At any time that a received sample amplitude is less than the predetermined threshold (block 41), a timer is incremented (block 50); and whenever the preset time runs out (block 51), the counter is also zeroized (block 45).

As one example, the mentioned count in block 45 may be 20 counts; and the time-out period for block 51 may be 5 seconds.

Figure 7:
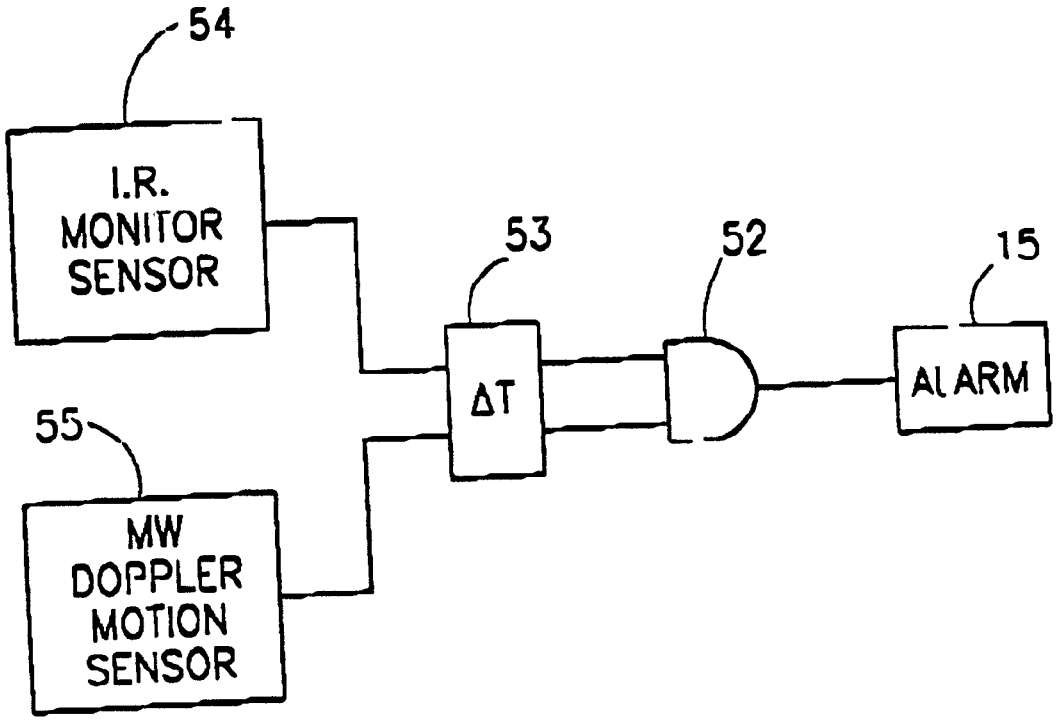
FIG. 7 is a block diagram illustrating an intrusion detection system including the combination of a Doppler motion sensor apparatus as described above together with an infra-red radiation motion sensor apparatus both controlling the actuation of the alarm.

The Doppler motion sensors illustrated in FIGS. 1–3 and/or in FIGS. 5 and 6, may be used as stand-alone systems for detecting intrusion. Preferably, however, the Doppler system is used in combination with an infrared radiation motion sensor in order to further reduce the possibility of false alarms. This is schematically illustrated in FIG. 7, wherein the output of an infrared radiation motion sensor 50 is applied concurrently with the output of a microwave (or ultrasonic) Doppler motion sensor 51 to an AND-gate 52, via a delay circuit 53, so that an alarm signal must be produced from both sensors, within a predetermined time window (e.g. a few seconds) as determined by delay circuit 53, in order to actuate the alarm 15.

While the invention has been described with respect to several preferred embodiments, it will be appreciated that these are set forth merely for illustration purposes and not for limitation purposes. Thus, the filtering method and filtering circuit could be used in many other applications where it is desirable to remove cyclically-repeating noise from a true signal. In addition, the Doppler motion sensor (microwave or ultrasonic) could be used in systems, such as in velocity measurement systems, other than intrusion detector systems. Many other variations, modifications and applications of the invention will be apparent.

What is claimed is:

1. A method of filtering an input signal which includes noise cyclically repeating at a known noise frequency, to substantially remove said noise from the input signal, comprising:

sampling the input signal at a frequency corresponding to a whole multiple "N" of said noise frequency;

sequentially storing said samples in 0-N storage devices;

sequentially subtracting the sample in each storage device from the sample previously stored in the $N^{th}$ storage device preceding the respective storage device, to thereby produce for each sample, a difference sample in which the cyclically repeating noise is effectively cancelled from the respective sample;

and sequentially outputting said difference samples to produce an output signal from which said cyclically repeating noise has been substantially removed.

2. The method according to claim 1, wherein "N" is a whole number greater than "1" such that harmonics of said cyclically repeating noise are also substantially removed.

3. The method according to claim 2, wherein "N" is at least "12".

4. The method according to claim 2, wherein said noise frequency is 50 Hz, "N" is 12, and the sampling frequency is 600 Hz.

5. The method according to claim 2, wherein said noise frequency is 60 Hz, "N" is 12, and the sampling frequency is 720 Hz.

6. The method according to claim 1, wherein said input signal is an analog signal, is converted to digital form, and is sequentially stored in digital form in said 0-N storage devices.

7. The method according to claim 6, wherein said 0-N storage devices define a shift register operating in a FIFO manner.

8. The method according to claim 1, wherein said input signal is the output of a Doppler motion sensor device.

9. The method according to claim 8, wherein said Doppler device is a microwave device.

10. The method according to claim 8, wherein said Doppler device is an ultrasonic device.

11. The method according to claim 8, wherein said Doppler device is in an intrusion detector system to produce an alarm signal when a moving object is detected within a monitored space.

12. The method according to claim 11, wherein:

each sample of the input signal is also examined for a change in amplitude over the previous sample;

for each such change in amplitude over a threshold, the duration of the change in amplitude is measured from the time of the amplitude change until the time the amplitude of a subsequent sample input signal drops below the threshold;

and maintaining an alarm signal only for those changes in amplitude having a duration shorter than a predetermined time period.

13. A method of detecting an intrusion in a monitored space by a Doppler system, wherein a transmitter transmits energy at a predetermined frequency into the monitored space, a receiver receives the energy as reflected from an object in the monitored space, and a mixer mixes a sample of the transmitted energy and the received energy and outputs a signal having an amplitude corresponding to the velocity of motion of an object reflecting the energy; comprising:

digitizing and sampling the signal amplitude outputted from the mixer;

examining each sample for a change in amplitude over a threshold with respect to the previous sample;

measuring the duration of the change in amplitude from the time of the change in amplitude until the time the amplitude of a subsequent sample input signal drops below the threshold;

and maintaining an alarm signal only for those changes in amplitude having a duration shorter than a predetermined time.

14. The method according to either of claims 12 or 13, wherein the alarm signal is produced whenever a change in amplitude is detected over a threshold with respect to the previous signal, and the alarm signal is terminated whenever said duration exceeds a predetermined time period.

15. The method according to claim 13, wherein said transmitted energy is microwaves.

16. The method according to claim 13, wherein said transmitted energy is ultrasonic.

17. The method according to claim 12, wherein said intrusion detector system also includes an infrared radiation motion sensor device which outputs an alarm signal when it detects an intrusion, and an alarm which is actuated only when both the Doppler motion sensor device and the infrared radiation motion sensor device output an alarm signal within a predetermined period of time.

18. An electronic filter for filtering an input signal which includes noise cyclically repeating at a known noise frequency, to substantially remove said noise from the input signal, comprising:

a sampling device for sampling the input signal at a frequency corresponding to a whole multiple "N" of said noise frequency;

a shift register including 0-N registers for sequentially storing said samples in said registers, and for reading them out from said registers in a FIFO manner;

and a subtractor for sequentially subtracting the sample in each register from the sample previously stored in the $N^{th}$ register to thereby sequentially produce, for each sample, a difference sample in which the cyclically-repeating noise is effectively cancelled from the respective sample.

19. The filter according to claim 18, wherein "N" is a whole number greater than "1" such that harmonics of said cyclically repeating noise are also substantially removed.

20. The filter according to claim 19, wherein "N" is at least "12".

21. The filter according to claim 20, wherein said noise frequency is 50 Hz, "N" is "12", and the sampling frequency is 600 Hz.

22. The filter according to claim 20, wherein said noise frequency is 60 Hz, "N" is "12", and the sampling frequency is 720 Hz.

23. The filter according to claim 18, wherein said input signal is in an analog form, and said filter includes an analog-to-digital converter for converting said input signal to digital form when sampled and stored in said shift register.

24. A Doppler motion sensor device for sensing motion of an object, comprising:

a transmitter for transmitting energy at a predetermined frequency;

a receiver for receiving said energy after reflection from an object;

a mixer for mixing the transmitted energy and the received energy, and for outputting a signal having an amplitude corresponding to the velocity of motion of an object reflecting said energy;

and an electronic filter according to any one of claims 18–23 for substantially removing cyclically-repeating noise from said output signal from the mixer.

25. The device according to claim 24, wherein said transmitted energy is microwaves.

26. The device according to claim 24, wherein said transmitted energy is ultrasonic.

27. The device according to claim 24, wherein said Doppler motion sensor device is in an intrusion detector system to produce an alarm signal when a moving object is detected within a monitored space.

28. The device according to claim 27, wherein:

the signal outputted by the mixer is sampled;

each sample of said latter signal is examined for a change in amplitude over the previous sample;

for each such change in amplitude over a threshold, the duration of the change in amplitude is measured from the time of the change in amplitude until the time the amplitude of a subsequent sample drops below the threshold;

and said alarm signal is terminated whenever said duration exceeds a predetermined time period.

29. The device according to either of claims 27 or 28, wherein said intrusion detector system also includes an infrared radiation motion sensor device which also outputs an alarm signal when it detects an intrusion, and an alarm which is actuated only when both the Doppler motion sensor device and the infrared radiation motion sensor device output an alarm signal within a predetermined period of time.

30. Apparatus for detecting an intrusion in a monitored space by a Doppler system, comprising:

a transmitter for transmitting energy at a predetermined frequency into the monitored space;

a receiver for receiving the energy as reflected from an object in the monitored space;

a mixer for mixing a sample of the transmitted energy and the received energy and for outputting a signal having an amplitude corresponding to the velocity of motion of an object reflecting the energy;

an A/D converter for digitizing and sampling the signal amplitude outputted from the mixer;

and a processor for examining each sample for a change in amplitude over a threshold with respect to the previous sample, for measuring the duration of the change in amplitude until the amplitude of a subsequent sample input signal drops below the threshold, and for maintaining an alarm signal only for those changes in amplitude having a duration shorter than a predetermined time.

31. The apparatus according to claim 30, wherein the alarm signal is produced whenever a change in amplitude is detected over a threshold with respect to the previous signal, and the alarm signal is terminated whenever said duration exceeds a predetermined time period.

32. The apparatus according to claim 31, wherein said Doppler system is a microwave system.

33. The apparatus according to claim 31, wherein said Doppler system is an ultrasound system.

* * * * *